US008204259B2

(12) United States Patent
Akino

(10) Patent No.: US 8,204,259 B2
(45) Date of Patent: Jun. 19, 2012

(54) CONDENSER MICROPHONE

(75) Inventor: Hiroshi Akino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 212 days.

(21) Appl. No.: 12/805,077

(22) Filed: Jul. 12, 2010

(65) Prior Publication Data

US 2011/0013800 A1 Jan. 20, 2011

(30) Foreign Application Priority Data

Jul. 14, 2009 (JP) ..... 2009-165476

(51) Int. Cl.
*H04R 3/00* (2006.01)

(52) U.S. Cl. ..... 381/113; 381/174; 381/355

(58) Field of Classification Search ..... 381/113, 381/174, 355, 369
See application file for complete search history.

(56) References Cited

U.S. PATENT DOCUMENTS 1,988,001 A * 1/1935 Flanders ..... 381/113
3,944,756 A * 3/1976 Lininger ..... 381/355
4,495,641 A * 1/1985 Vernino ..... 381/91
4,790,021 A * 12/1988 Pribyl ..... 381/191
4,888,807 A * 12/1989 Reichel ..... 381/92
7,599,505 B2 * 10/2009 Akino ..... 381/113
8,085,965 B2 * 12/2011 Akino ..... 381/368
2005/0254670 A1 * 11/2005 Akino ..... 381/113
2007/0242841 A1 * 10/2007 Akino ..... 381/174
2008/0171261 A1 * 7/2008 Wang ..... 429/100
2011/0013800 A1 * 1/2011 Akino ..... 381/361

* cited by examiner

*Primary Examiner* — David S. Warren
(74) *Attorney, Agent, or Firm* — Manabu Kanesaka

(57) ABSTRACT

In a condenser microphone having a battery holder and a battery cover therefor, one part is used as a member for grounding the battery cover and as a member for preventing the battery cover from coming off. In a condenser microphone 1 including a microphone housing 2 formed of a metallic cylindrical body; an output connector 4 provided with a predetermined number of terminal pins 43 in a metallic connector sleeve 41; a battery holder 3 provided between the microphone housing 2 and the output connector 4; and a battery cover 5 formed of a metallic cylindrical body for opening/closing the battery holder 3 by sliding, a first ring-shaped groove 41*a* is formed in the outer peripheral surface of the connector sleeve 41; in the first ring-shaped groove 41*a*, there is disposed a conductive member 6 consisting of a circular conical tube body in which one end thereof on the battery holder 3 side is in elastic contact with the inner peripheral surface of the battery cover 5, and the other end thereof on the opposite side has a diameter approximately equal to the diameter of the groove bottom of the first ring-shaped groove 41*a*; and in the inner peripheral surface of the battery cover 5, there is formed a second ring-shaped groove 52 with which the one end of the conductive member 6 increases in diameter and engages.

4 Claims, 2 Drawing Sheets

CONDENSER MICROPHONE

CROSS-REFERENCE TO RELATED APPLICATION

The present application is based on, and claims priority from, Japanese Application Serial Number JP2009-165476, filed Jul. 14, 2009, the disclosure of which is hereby incorporated by reference herein in its entirety.

TECHNICAL FIELD

The present invention relates to a condenser microphone. More particularly, it relates to a shield structure in a condenser microphone incorporating a driving battery.

BACKGROUND ART

A condenser microphone is provided with a condenser microphone unit (an electrostatic acoustic-electric converter) including a diaphragm and a backplate disposed opposedly, and the output impedance of the condenser microphone unit is very high. Therefore, the condenser microphone unit incorporates an impedance converter for converting impedance to low one. In many cases, as the impedance converter, a field effect transistor (FET) has been used.

Usually, the condenser microphone is used by being connected to a phantom power source via a balanced shielded cable. Therefore, the condenser microphone is provided with an output connector in the rear end part of a microphone housing thereof.

As the output connector, an output connector specified in EIAJ RC-5236 "Latch Lock Type Round Connector for Audio Equipment" is used. This output connector has three terminal pins, No. 1 pin being used as grounding, No. 2 pin as the hot side of signal, and No. 3 pin as the cold side of signal.

As described above, most of the condenser microphones are used by being connected to the phantom power source via the balanced shielded cable. However, the microphone used outdoors frequently, such as a superdirectional gun type condenser microphone, incorporates a battery serving as a driving power source.

In the microphone incorporating a driving battery, a battery holder for accommodating an AA size battery or the like is provided between the microphone housing having the microphone unit and the output connector, and a cylindrical battery cover is slidably put on the battery holder (for example, refer to Japanese Patent Application Publication No. 2006-33463).

As measures against noise caused by electromagnetic waves, the microphone housing including the output connector part is required to have high shieldability. However, the battery built-in type condenser microphone has a movable part, the battery cover, as described above, and the grounding thereof is difficult to do, so that a high-frequency current caused by external electromagnetic waves (especially, strong electromagnetic waves emitted from a cellular phone) intrudes into the microphone housing through a contacting part of the movable part and a fixed part, whereby the high-frequency current is detected by the FET, and noise is generated easily.

Therefore, the invention described in Japanese Patent Application Publication No. 2006-33463 discloses a method in which with the insertion of a plug of a microphone cord (balanced shielded cable) into the output connector, a plate spring comes into contact with the battery cover, thereby making electrical continuity.

However, in this method, since the contacting part is a point contact, a sufficient effect cannot sometimes be achieved in inhibiting the high-frequency and high-output electromagnetic waves emitted from the cellular phone.

The invention described in Japanese Patent Application Publication No. 2006-2033407 proposes a technique in which a conductive cloth is disposed between the battery cover and a connector sleeve of the output connector to make electrical continuity.

According to this technique, since the battery cover and the connector sleeve of the output connector are in planar contact with each other via the conductive cloth, noise caused by electromagnetic waves can be prevented. However, problems to be solved remain still.

One of the problems is that when the battery is exchanged, the battery cover is slid to the output connector side to open the battery holder, and at this time, if a coming-off preventing device for the battery cover is not provided, the battery cover comes off inadvertently. If the coming-off battery cover collides with a floor surface or the like and is deformed, the battery cover becomes unusable.

Conventionally, therefore, a stopper ring that comes into contact with the end face of the connector sleeve has been provided on the inner peripheral surface of the battery cover to prevent the battery cover from coming off. However, the provision of the stopper ring separately from the conductive cloth increases the number of parts, which is unfavorable in terms of cost. Also, it increases the manpower for assembling work, which is also unfavorable in terms of productivity.

Accordingly, an object of the present invention is to provide a condenser microphone having a battery holder and a battery cover (movable part) therefor, in which one part is used as a member for grounding the battery cover and as a member for preventing the battery cover from coming off.

SUMMARY OF THE INVENTION

To achieve the above object, the present invention provides a condenser microphone including a microphone housing formed of a metallic cylindrical body having a microphone unit; an output connector provided with a predetermined number of terminal pins in a metallic connector sleeve; a battery holder provided between the microphone housing and the output connector; and a battery cover formed of a metallic cylindrical body for opening/closing the battery holder by sliding, the battery cover having a length for covering at least a part of the connector sleeve in a state in which the battery holder is closed, and being slid to the output connector side when the battery holder is opened, wherein a first ring-shaped groove is formed in the outer peripheral surface of a portion covered with battery cover of the connector sleeve; in the first ring-shaped groove, there is disposed a conductive member consisting of a circular conical tube body in which one end thereof on the battery holder side has a diameter larger than the inside diameter of the battery cover in a no-load state and is in elastic contact with the inner peripheral surface of the battery cover, and the other end thereof on the opposite side has a diameter approximately equal to the diameter of the groove bottom of the first ring-shaped groove; and in the inner peripheral surface of the battery cover, there is formed a second ring-shaped groove with which the one end of the conductive member increases in diameter and engages when the battery holder is open.

In the present invention, it is preferable that at least on one end side of the circular conical tube body, a plurality of slot grooves be formed at predetermined intervals.

According to the present invention, in the first ring-shaped groove formed in the outer peripheral surface of the connector sleeve, there is disposed the conductive member consisting of the circular conical tube body in which one end thereof on the battery holder side has a diameter larger than the inside diameter of the battery cover in a no-load state and is in elastic contact with the inner peripheral surface of the battery cover, and the other end thereof on the opposite side has a diameter approximately equal to the diameter of the groove bottom of the first ring-shaped groove, and in the inner peripheral surface of the battery cover, there is formed the second ring-shaped groove with which the one end of the conductive member increases in diameter and engages when the battery holder is opened. Therefore, in the state in which the battery cover is closed, since the battery cover and the connector sleeve for grounding are connected to each other at many points via the conductive member, a reliable shield against electromagnetic waves is formed around the battery holder.

The circular conical tube body is preferably formed of a plate spring material; however, it may be formed of an elastically deformable synthetic resin plate material the surface of which is metal plated.

When the battery cover is slid to the connector sleeve side to open the battery holder, one end of the conductive member increases in diameter and engages with the second ring-shaped groove of the battery cover to automatically lock the battery cover to prevent coming-off, so that the battery cover does not come off inadvertently.

DETAILED DESCRIPTION

An embodiment of the present invention will now be described with reference to FIGS. 1 to 3. The present invention is not limited to this embodiment.

Figure 1:
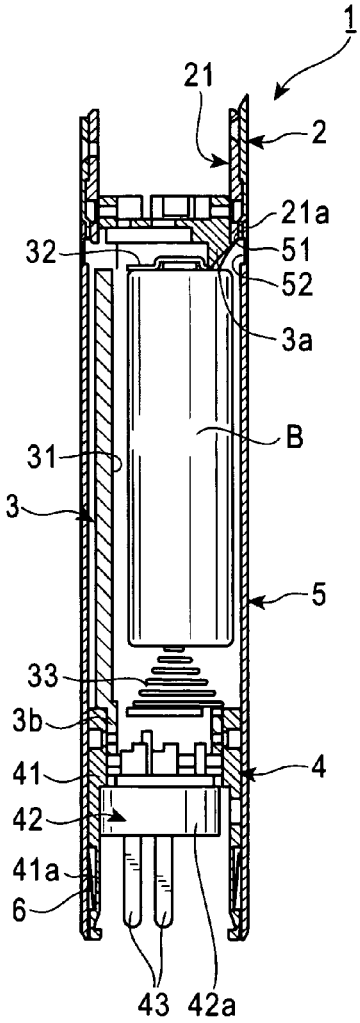
FIG. 1 is a sectional view of an essential portion of a condenser microphone in accordance with an embodiment of the present invention.
Figure 2:
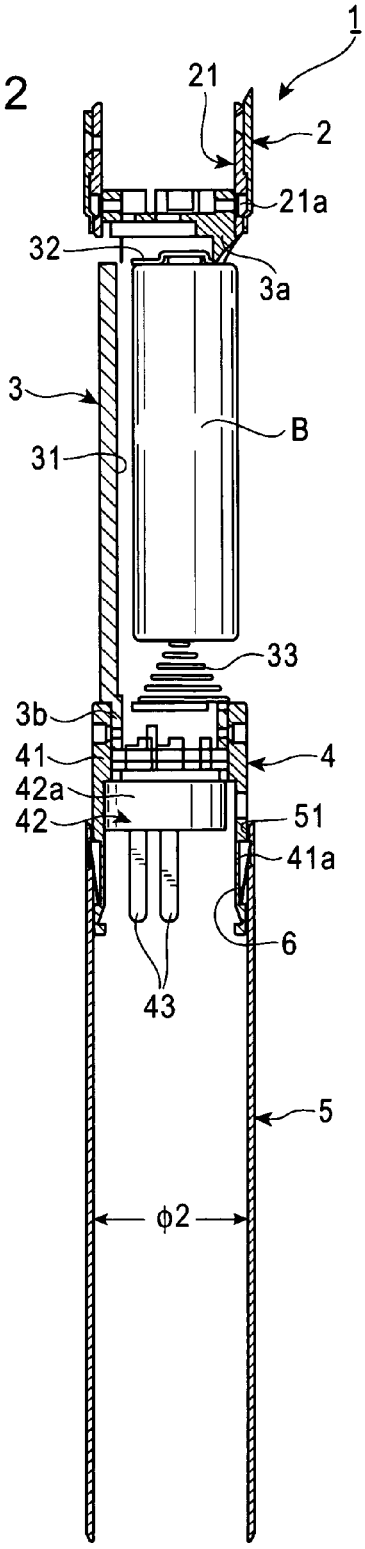
FIG. 2 is a sectional view showing a state in which a battery cover is open in an embodiment.

As shown in FIGS. 1 and 2, for a condenser microphone 1, a battery holder 3 is provided between a microphone housing 2 and an output connector 4, and is provided with an openable/closable battery cover 5.

Although FIGS. 1 and 2 show only the rear end part of the microphone housing 2, the microphone housing 2 is formed in a cylindrical shape by using a metallic material such as a brass alloy. In the interior thereof or on the front end side thereof, a condenser microphone unit (not shown) is mounted.

The battery holder 3 is made of a synthetic resin, and is provided with a ship's bottom shaped battery accommodating part 31 for accommodating a rod-like battery B such as an AA size battery. On the anode end part 3*a* side of the battery holder 3, an anode contact 32 consisting of a plate spring is provided, and on the cathode end part 3*b* side thereof, a cathode contact 33 consisting of a coil spring is provided.

The anode end part 3*a* of the battery holder 3 is connected to the rear end part of the microphone housing 2 via a connecting cylinder 21. The connecting cylinder 21 is preferably made of a metal, the same material as that of the microphone housing 2, and the front end thereof is inserted in the microphone housing 2 and is screwed.

The anode end part 3*a* of the battery holder 3 is inserted in the connecting cylinder 21 and is screwed. On the outer peripheral surface on the rear end side of the connecting cylinder 21, external threads 21*a* are formed.

To the cathode end part 3*b* of the battery holder 3, the output connector 4 is connected. The output connector 4 is a three-pin type output connector specified in EIAJ RC-5236 "Latch Lock Type Round Connector for Audio Equipment", and includes a connector sleeve 41 made of a metallic material and a connector main body 42 disposed therein.

The connector main body 42 has a disc-shaped base 42*a* made of a synthetic resin, and on the base 42*a*, three terminal pins 43 of No. 1 to No. 3 pins are penetratingly provided. For convenience of drawing the figure, in FIGS. 1 and 2, only two of the three terminal pins 43 are shown.

The connector main body 42 is fixed in the connector sleeve 41 by a fixing screw (not shown). The No. 1 pin for grounding is electrically connected to the connector sleeve 41 by a predetermined conductive means, and the No. 2 and No. 3 pins are brought into the microphone housing 2 via lead wires (not shown) installed in the battery holder 3.

The battery cover 5 is formed of a metallic cylindrical body having an outside diameter that is substantially the same as the outside diameter of the microphone housing 2. The material of the battery cover 5 is preferably the same as the material of the microphone housing 2.

As shown in FIG. 1, the battery cover 5 preferably has an axial length for covering the battery holder 3 and the output connector 4 in a closed state, that is, a length between the rear end of the microphone housing 2 and the rear end of the output connector 4. However, the battery cover 5 has only to have a length for covering at least a part on the battery holder 3 side of the output connector 4.

According to the present invention, in the outer peripheral surface of the connector sleeve 41, a first ring-shaped groove 41*a* having a predetermined depth is formed. In the case where the battery cover 5 has a length for covering a part on the battery holder 3 side of the output connector 4, the first ring-shaped groove 41*a* is provided in a portion covered by the battery cover 5.

On the inner peripheral surface on the front end side (the left end side in FIGS. 1 and 2) of the battery cover 5, internal threads 51 threadedly engaged with the external threads 21*a* of the connecting cylinder 21 are formed. In a portion rear from the internal threads 51 on the inner peripheral surface of the battery cover 5, a second ring-shaped groove 52 having a predetermined depth is formed.

According to the present invention, a conductive member 6 is disposed in the first ring-shaped groove 41*a* of the connector sleeve 41. The conductive member 6 has a function of electrically connecting the battery cover 5 to the connector sleeve 41 and a function of serving as a stopper for preventing the battery cover 5 from coming off.

Figure 3A:
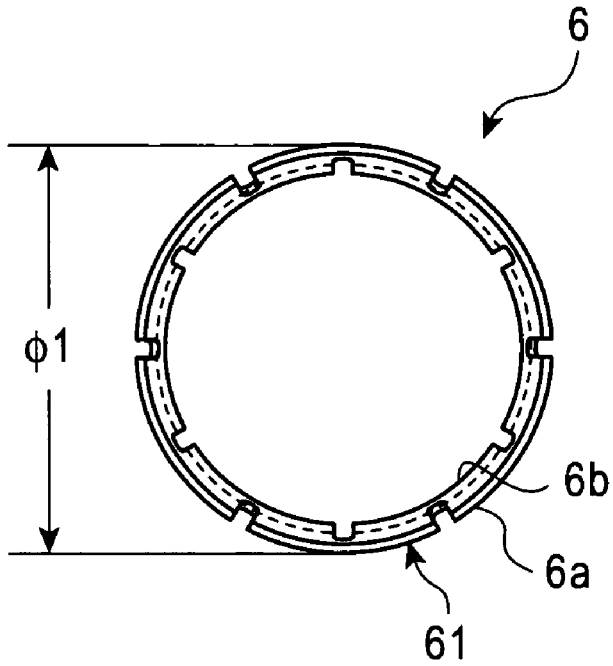
FIG. 3A is a front view of a conductive member used in the present invention.
Figure 3B:
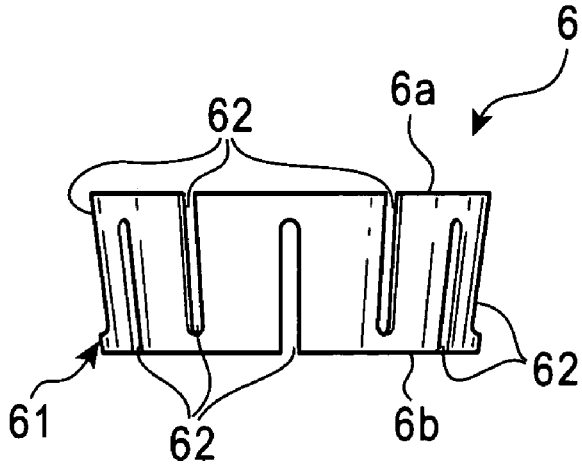
FIG. 3B is a central sectional view of a conductive member used in the present invention.

Referring to FIGS. 3A and 3B, the conductive member 6 consists of an elastically deformable circular conical tube body 61, one end 6*a* of which has a larger diameter and the other end 6*b* of which has a diameter smaller than the diameter of the one end 6*a*. The material of the conductive member 6 is preferably a plate spring material. However, the conductive member 6 may be formed of a synthetic resin plate material. In this case, to obtain the conductivity, the surface of the conductive member 6 is chrome plated, for example.

The outside diameter $\phi 1$ in a no-load state (natural state) on the one end 6*a* side of the circular conical tube body 61 is larger than the inside diameter $\phi 2$ of the battery cover 5.

Whereas, the inside diameter on the other end 6*b* side of the circular conical tube body 61 may be approximately equal to the diameter of the groove bottom of the first ring-shaped groove 41*a*.

The circular conical tube body 61 is provided with a plurality of slot grooves 62 for ease of elastic deformation. Each of the slot grooves 62 consists of a slit groove formed from one end in the axial direction toward the center. In this example, the slot grooves 62 are formed throughout the entire periphery at equal intervals alternately from both end parts of the body 61.

As shown in FIGS. 1 and 2, the circular conical tube body 61 is disposed in the first ring-shaped groove 41*a* in the connector sleeve 41 with the one end 6*a* on the large-diameter side being on the battery holder 5 side.

At the actual assembly time, a part of the circular conical tube body 61 is separated into a band plate shape, and the band plate shaped part is wound in the first ring-shaped groove 41*a* to form a band shape. In this meaning, the body 61 need not be a complete cylindrical body, and may be a C-shaped incomplete cylindrical body having a gap in a part. Also, in the case where a part of the body 61 is wound in the first ring-shaped groove 41*a* to form a band shape, both ends thereof may be connected to each other with an adhesive tape or the like.

Thereafter, the battery cover 5 is fitted from the rear end (the right end in FIGS. 1 and 2) of the connector sleeve 41, and the battery cover 5 is turned, for example, in the clockwise direction to threadedly engage the internal threads 51 with the external threads 21*a* of the connecting cylinder 21, whereby as shown in FIG. 1, the battery holder 3 is closed by the battery cover 5.

In this state, the one end 6*a* of the circular conical tube body 61 is decreased in diameter by the battery cover 5, and the circular conical tube body 61 is reliably brought into contact with the inner peripheral surface of the battery cover 5 at many points by the rebounding force thereof. Therefore, the battery cover 5 is electrically connected to the connector sleeve 41 on the grounding side integrally, and proper electromagnetic wave shieldability is given to the battery cover 5. Also, play of the battery cover 5 can be kept small.

In order to exchange the battery B, the battery cover 5 is turned in the counterclockwise direction to disengage the internal threads 51 for the external threads 21, and thereafter the battery cover 5 is slid to the output connector 4 side to expose the battery holder 3 as shown in FIG. 2.

At this time, if the battery cover 5 is slid to the output connector 4 side than necessary, at a time point when the second ring-shaped groove 52 arrives at the position of the first ring-shaped groove 41*a*, the one end 6*a* of the circular conical tube body 61 is increased in diameter by the own restoring force, and intrudes into the second ring-shaped groove 52. Thereby, the battery cover 5 is prevented from coming off As described above, according to the present invention, by the conductive member 6 consisting of the circular conical tube body 61, having elasticity and conductivity, proper electromagnetic wave shieldability can be given to the battery cover 5, and at the time of battery exchange and the like, the battery cover 5 can be prevented from coming off.

The invention claimed is:

1. A condenser microphone comprising:

a microphone housing formed of a metallic cylindrical body having a microphone unit;

an output connector provided with a predetermined number of terminal pins in a metallic connector sleeve;

a battery holder provided between the microphone housing and the output connector; and a battery cover formed of a metallic cylindrical body for opening and closing the battery holder by sliding, the battery cover having a length for covering at least a part of the connector sleeve in a state in which the battery holder is closed, and being slid to the output connector side when the battery holder is opened, wherein a first ring-shaped groove is formed in the outer peripheral surface of a portion covered with the battery cover of the connector sleeve;

in the first ring-shaped groove, there is disposed a conductive member consisting of a circular conical tube body in which one end thereof on the battery holder side has a diameter larger than the inside diameter of the battery cover in a no-load state and is in elastic contact with the inner peripheral surface of the battery cover, and the other end thereof on the opposite side has a diameter approximately equal to the diameter of the groove bottom of the first ring-shaped groove; and in the inner peripheral surface of the battery cover, there is formed a second ring-shaped groove with which the one end of the conductive member increases in diameter and engages when the battery holder is opened.

2. The condenser microphone according to claim 1, wherein at least on one end side of the circular conical tube body, a plurality of slot grooves are formed at predetermined intervals.

3. The condenser microphone according to claim 1, wherein the circular conical tube body is formed of a plate spring material.

4. The condenser microphone according to claim 1, wherein the circular conical tube body is formed of an elastically deformable synthetic resin plate material the surface of which is metal plated.

* * * * *